US009151208B2

(12) United States Patent
Schumnig

(10) Patent No.: US 9,151,208 B2
(45) Date of Patent: Oct. 6, 2015

(54) EXHAUST MANIFOLD OF AN INTERNAL COMBUSTION ENGINE

(75) Inventor: Oliver Schumnig, Gundersheim (DE)

(73) Assignee: BorgWarner Inc., Auburn Hills, MI (US)

( * ) Notice: Subject to any disclaimer, the term of this patent is extended or adjusted under 35 U.S.C. 154(b) by 367 days.

(21) Appl. No.: 12/921,430

(22) PCT Filed: Mar. 11, 2009

(86) PCT No.: PCT/US2009/036719

§ 371 (c)(1),
(2), (4) Date: Sep. 8, 2010

(87) PCT Pub. No.: WO2009/114568

PCT Pub. Date: Sep. 17, 2009

(65) Prior Publication Data

US 2011/0016859 A1 Jan. 27, 2011

(30) Foreign Application Priority Data

Mar. 13, 2008 (DE) ..... 10 2008 014 056

(51) Int. Cl.
*F01N 1/00* (2006.01)
*F01N 13/10* (2010.01)
(Continued)

(52) U.S. Cl.
CPC ..... *F01N 13/10* (2013.01); *F01N 13/1816* (2013.01); *F02B 37/00* (2013.01)

(58) Field of Classification Search
CPC ..... F01N 13/10; F01N 13/1816; F02B 37/00
USPC ..... 60/323, 324
See application file for complete search history.

(56) References Cited

U.S. PATENT DOCUMENTS 4,288,988 A * 9/1981 Curtil ..... 60/605.1
4,860,852 A 8/1989 Valev (Continued)

FOREIGN PATENT DOCUMENTS

EP 0736714 A1 * 10/1996
EP 1426557 A1 * 6/2004

(Continued)

OTHER PUBLICATIONS

English translation of Japanese Patent Application No. JP-5156956 A.*

*Primary Examiner* — Jason Shanske
(74) *Attorney, Agent, or Firm* — A. Michael Tucker; Stephan A. Pendorf; Patent Central LLC

(57) ABSTRACT

The invention relates to an exhaust manifold (18) of an interna! combustion engine (20), with a number of exhaust pipe bends (1) corresponding to the number of cylinders of the internal combustion engine (20), said exhaust pipe bends being brought together at one end into an input flange (2 ) which can be fastened to the internal combustion engine (20), and being brought together at the other end; with a supply gas duct (21) which is connected at one end to a collector component (4) and at the other end to a rotor space (15) of a turbine housing (17) of a turbine of an exhaust-gas turbocharger; and with at least one compensator (19') for compensating for thermal stresses in at least one exhaust pipe bend (1) and the supply gas duct (21), wherein the at least one compensator (19') is designed as a component which is integrated in at least one exhaust pipe component (1).

15 Claims, 3 Drawing Sheets

(51) Int. Cl.
*F01N 13/18* (2010.01)
*F02B 37/00* (2006.01)

(56) References Cited

U.S. PATENT DOCUMENTS 5,689,954 A * 11/1997 Blocker et al. ..... 60/322
5,911,683 A * 6/1999 Cui et al. ..... 60/302
5,967,565 A * 10/1999 Kim ..... 285/49
6,032,463 A * 3/2000 Bock ..... 60/323
6,151,893 A * 11/2000 Watanabe et al. ..... 60/322
6,164,703 A * 12/2000 Kim ..... 285/49
6,315,332 B1 * 11/2001 Aschoff et al. ..... 285/227
6,360,532 B2 3/2002 Straehle et al.
6,419,280 B2 * 7/2002 Uegane et al. ..... 285/300
2002/0040195 A1 * 4/2002 Takehara et al. ..... 600/551
2004/0109759 A1 * 6/2004 Korner ..... 415/205
2005/0086936 A1 * 4/2005 Bucknell et al. ..... 60/602

FOREIGN PATENT DOCUMENTS

JP 05-156956 A 6/1993
WO 99-36685 A1 7/1999

* cited by examiner

EXHAUST MANIFOLD OF AN INTERNAL COMBUSTION ENGINE

FIELD OF INVENTION

The invention relates to an exhaust manifold of an internal combustion engine.

BACKGROUND OF THE INVENTION

An exhaust manifold of this type is known from EP 1 426 557 A1.

A technical problem occurring in the case of exhaust manifolds of this type is thermal expansion which occurs both between the exhaust pipe bends themselves, but also between said pipe bends and a supply gas duct of the turbine housing of an exhaust-gas turbocharger connected to the exhaust manifold. This thermal expansion has to be compensated for in order to avoid damage. If the exhaust manifold is designed as a double-walled, air-gap-insulated (AGI) manifold, use is made as compensators therefor of internal sliding fits which are not, however, gastight, since the pipe components forming the sliding fits are merely plugged one inside another, but are not welded in a gastight manner to one another. However, the leakages which occur as a result at the inner pipes of the AGI manifold smooth the exhaust pressure pulsations which are needed in the case of twin scroll applications for better utilization of power and therefore for increasing performance. Sliding fits at the connecting points result in the volume surrounding the pipe components and being formed by the outer, gastight casing being filled and emptied by the exhaust pressure pulsations.

The composition of the exhaust mixture in said outer volume changes, for example, with the degree of flushing of the cylinders with fresh air.

SUMMARY OF THE INVENTION

It is therefore the object of the present invention to provide an exhaust manifold of an internal combustion engine, making it possible, in particular if the manifold is designed as a single-walled sheet-metal manifold, to provide a structurally flexible, gastight configuration which can be produced cost effectively.

This object is achieved by an exhaust manifold of an internalcombustion engine. The exhaust manifold includes a number of exhaust pipe bends corresponding to the number of cylinders of the internal combustion engine. The exhaust pipe bends open at one end into an input flange, which can be fastened to the internal combustion engine. The exhaust pipe bends can be brought together at their end. The exhaust gas manifold includes a supple gas duct. The supply duct is connected at one end to a collector component and at the other end to a rotor space of a turbine housing of a turbine of an exhaust-gas turbocharger. The exhaust gas manifold includes one or more compensators. The one or more compensators can be configures to compensate for thermal stresses between the one or more exhaust pipe bends and the supply gas duct. Each of the one or more compensators is a component which is integrated is a respective one of the exhaust pipe bends.

The following features in particular are included in the particular advantages of the solution according to the invention:

- gastight pipe connection;
- exhaust composition is not changed by mixing an additional volume with gas. Better conditions for cylinder flushing as a result of increased valve overlapping;

- no efficiency losses as a result of internal leakage in the case of turbochargers with twin scroll applications;
- cost-neutral possibility of production in comparison to known sliding fit embodiments;
- no construction space losses for the outer shell which is required in the case of standard AGI manifolds, and therefore the solution according to the invention is virtually identical in terms of fit to single-wall manifolds;
- cost saving on account of omitting the outer shell;
- unrestricted use of the advantages of sheet-metal manifold embodiments in comparison to cast manifolds, such as, for example, short heating time of the catalytic converter and corresponding emission and power advantages.

Since it is customary in the case of sheet-metal manifolds according to current standards frequently to use pipes formed by internal high pressure (IHP pipes), it is advantageously possible, by means of the integrated design of the compensator, to form the latter neutrally in terms of costs during the forming by internal high pressure.

The exhaust manifold can have additional advantageous features and arrangements. For instance, the compensator can be a compensator bellows. The supply gas duct and the collector component can be welded to each other. At a minimum, the exhaust pipe bends together with the compensator can be pipes formed by internal high pressure. The compensator can be provided with a supporting sleeve. In one embodiment, the supporting sleeve can be arranged within the compensator. In such case, the supporting sleeve can be placed loosely within the compensator. The supporting sleeve can be welded at one of its ends to the collector component. In one implementation, the supporting sleeve can be fixed at one of its ends to an exhaust pipe bend. The compensator can be provided with at least two sheet-metal layers. The exhaust pipe bends can be surrounded be a heat protection sheet. The exhaust pie bends can be surrounded in a non-gastight manner by a heat protection sheet. In one embodiment, the turbine housing (17) can be a twin scroll turbine housing. In another embodiment, the turbine housing (17) can be a single-flow turbine housing.

In this connection, in particular the provision of a supporting sleeve should be mentioned, said supporting sleeve being placed loosely into the region of the compensator before the welding of the pipe components and preventing sagging transversely with respect to the axial direction of compensation by absorbing the bending forces which occur.

In a particularly preferred embodiment, it is possible to fix the supporting sleeve on one side, for which purpose, for example, welding is possible.

Furthermore, embodiment are directed to a turbine housing according to the invention, which constitutes a subject which can be treated independently. In one embodiment, the turbine housing is provided with an exhaust gas manifold as described above. In another embodiment, the turbine housing includes a supply gas duct which is fluidly connected to a rotor space of a turbine rotor. The supply gas duct can include a compensator as described above.

BRIEF DESCRIPTION OF THE DRAWINGS

Further details, advantages and features of the present invention emerge from the description below of exemplary embodiments with reference to the drawing, in which.

DETAILED DESCRIPTION OF THE INVENTION

Figure 1:
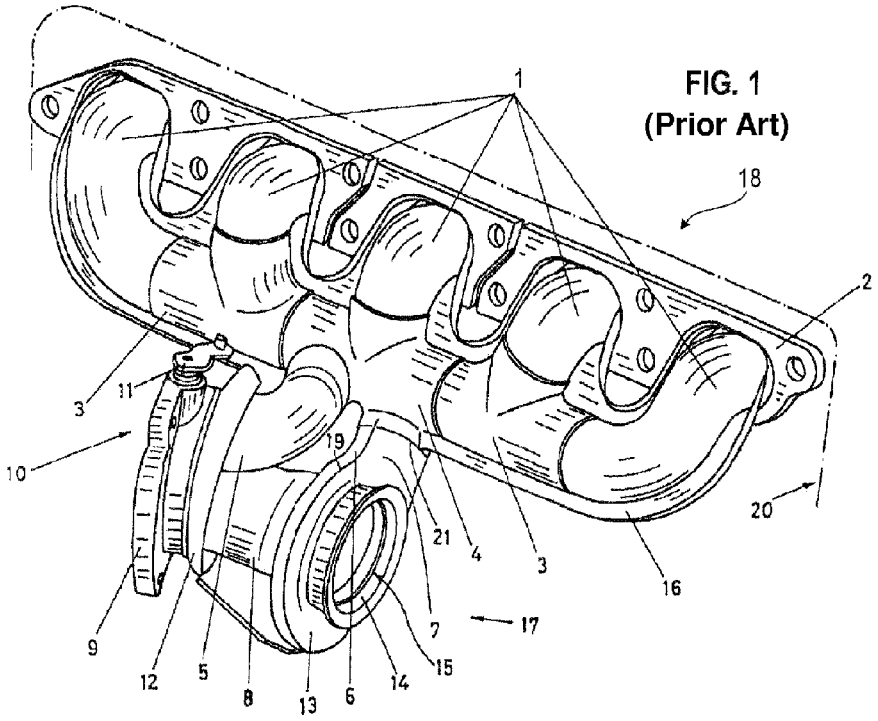
FIG. 1 (Prior Art)
FIG. 1 shows a perspective illustration of the essential parts of an AGI exhaust manifold with a turbine housing of an exhaust-gas turbocharger (prior art)

FIG. 1 shows a perspective view of an exhaust manifold 18 which is flange-mounted on an internal combustion engine 20 (indicated by a chain-dotted line) and is connected to a turbine housing 17 of an exhaust-gas turbocharger (not illustrated in its entirety). The illustration of said parts suffices for the explanations below of the principles of the present invention, wherein it should be emphasized that the exhaust-gas turbocharger of course has all of the other customary design features, but which are not reproduced in FIG. 1 so as to simplify the illustration.

According to the embodiment illustrated in FIG. 1, the internal combustion engine 20 has five exhaust pipe bends 1 which lead to associated T exhaust pipes 3 and are connected thereto, and open into a collector component 4 which is likewise designed as a T exhaust pipe, as revealed in detail in the graphical illustration of FIG. 1.

As explained, FIG. 1 merely shows an exemplary embodiment of an exhaust manifold, and therefore it is self-evident to a person skilled in the art that other types of exhaust manifold, in particular matched to the particular internal combustion engine, are also possible.

The exhaust manifold 18 illustrated in FIG. 1 corresponds to that of EP 1 426 557 A1 belonging to the applicant of the present application, and therefore the content of EP 1 426 557 A1 is hereby incorporated in its entirety, by reference to this application, in the content of disclosure of the present application, since a compensator according to the invention, to be described below, can also be used in the case of this exhaust manifold.

FIG. 1 shows in particular that the exhaust manifold 18 is connected to the collector component 4 via a supply gas duct 21. The supply gas duct 21 is connected in terms of flow to a rotor space 15 of the turbine housing 7, with the rotor space 15 accommodating the turbine rotor (not illustrated specifically in FIG. 1).

Figure 2:
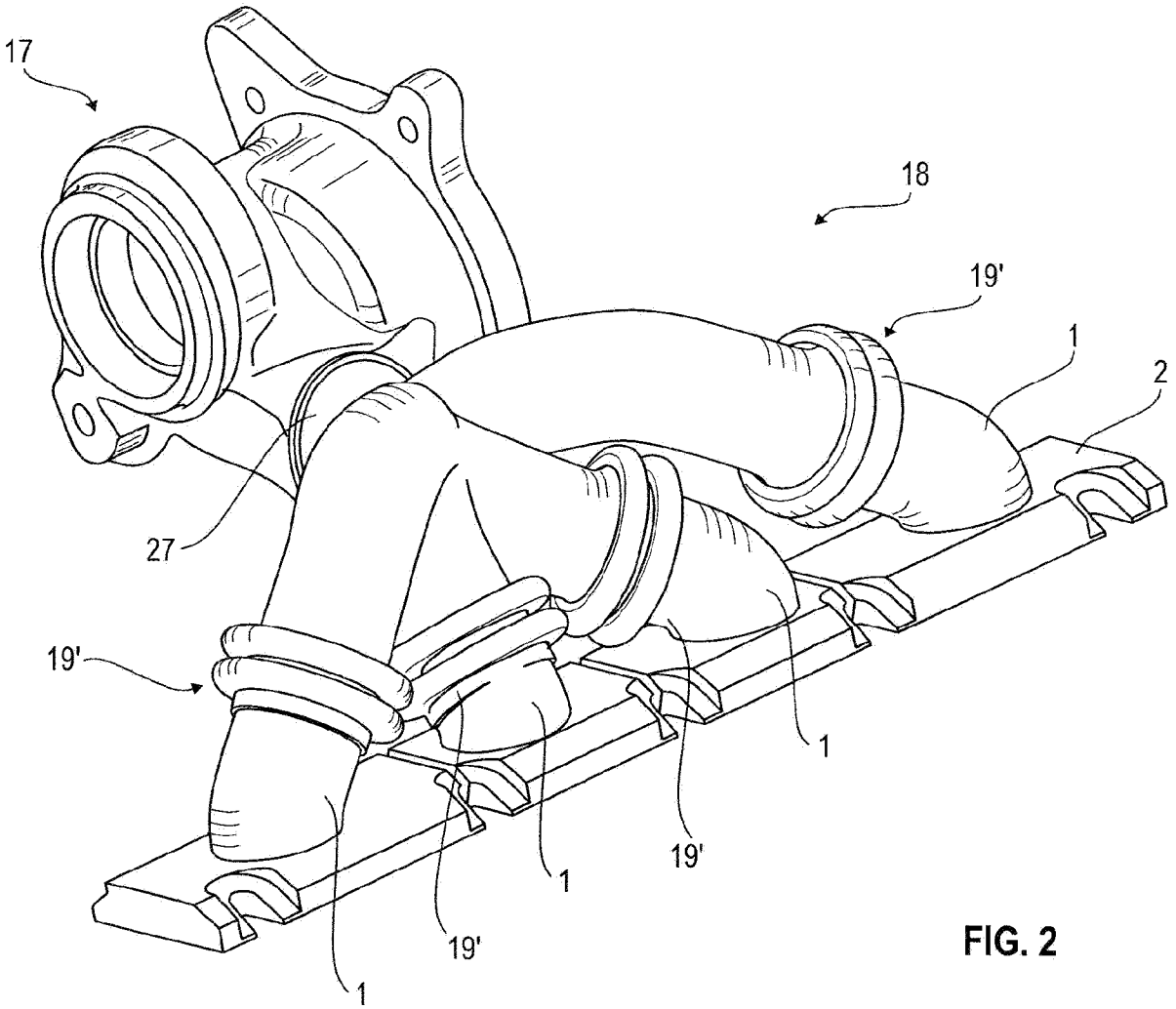
FIG. 2 shows a perspective illustration of an exhaust manifold according to the invention.

FIG. 2 shows the single-walled exhaust manifold according to the invention with pipe bends 1 together with compensators 19' and the turbine housing 17.

The use of the at least one compensator 19' in at least one pipe bend 1 is provided in this case. After all of the pipe bends 1 have been brought together, the arrangement of an additional compensator 19' in a connecting conduit 27 to the turbine housing 17 is possible, but not necessary.

Figure 3:
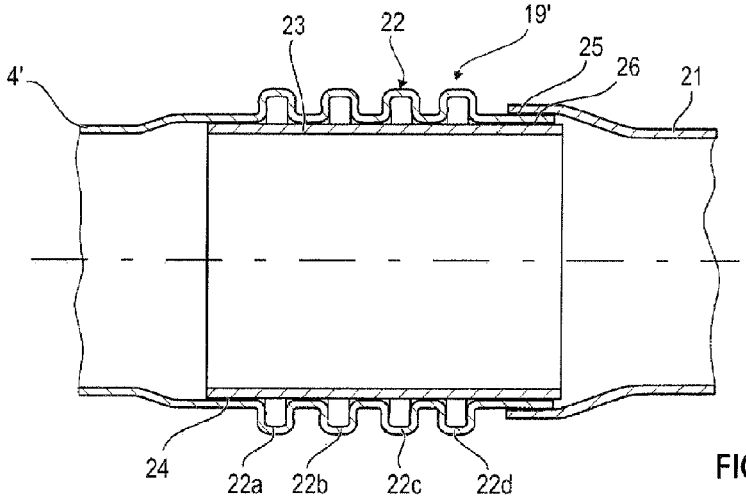
FIG. 3 shows a sectional illustration through a pipe connection between the exhaust manifold and a connecting pipe to the turbine housing in order to clearly show the compensator according to the invention which is integrated into the pipe connection.

In order to compensate for the thermal expansions, the exhaust manifold according to the invention has a compensator 19' which is illustrated in detail in the sectional illustration of FIG. 3.

For this purpose, FIG. 3 shows a pipe portion 4' of the pipe component 4 together with the compensator 19' which is designed as an integral component of said pipe component 4'.

As the sectional illustration of FIG. 3 shows, the compensator 19' is designed as a compensator bellows 22 which, in the case of the example, comprises four bellows parts 22*a*-22*d*. It goes without saying that the number of bellows parts can be varied depending on the application in order to be able to correspondingly compensate for thermal expansions which differ under some circumstances from case to case. As emerges from FIG. 3, the compensator 19' is an axial compensator which, in the case of the example, compensates for distortions between the pipe portion 4' and the supply gas duct 21. It should be mentioned that, in terms of principle, such a compensator 19' can likewise be used between the other pipe connection portions of the exhaust manifold 18.

The particular advantage of the integrated design of the compensator 19' is that it is now possible, according to the embodiment illustrated in FIG. 3, to weld the pipe portion 4' and the supply gas duct 21 to each other in a gastight manner, for which purpose a welded pipe joint 25 is provided.

In order, furthermore, to prevent sagging transversely with respect to the axial extent of the arrangement illustrated in FIG. 3, said particularly preferred embodiment furthermore has a supporting sleeve 23 which, as shown in FIG. 3, is arranged within the pipe connection in the region of the compensator 19'. Said supporting sleeve can be placed loosely into the arrangement during the course of the assembly and, if the need arises, can be fixed, for example at the welding point 24, to the pipe portion 4', with an inner sliding fit being produced at the point marked by the reference number 26.

Although, in the case of the particularly preferred embodiment illustrated in FIG. 3, a compensator bellows is illustrated as the compensator structure, other compensator structures are in principle also conceivable if they permit a gastight connection between the pipe components which are connected to one another.

Although, according to the particularly preferred embodiment of FIG. 3, the compensator 19' is an integral component of the pipe portion 4', it is also conceivable in principle to design the compensator 19' as an integral component of the supply gas duct 21.

It is also possible in principle to design the compensator 19' as a separate component which is an integral part of an intermediate pipe component which is then connected in a gastight manner at one of its ends to the exhaust manifold 18, such as, for example, the pipe portion 4', and at the other end to the supply gas duct 21 of the turbine housing 17.

Figure 4:
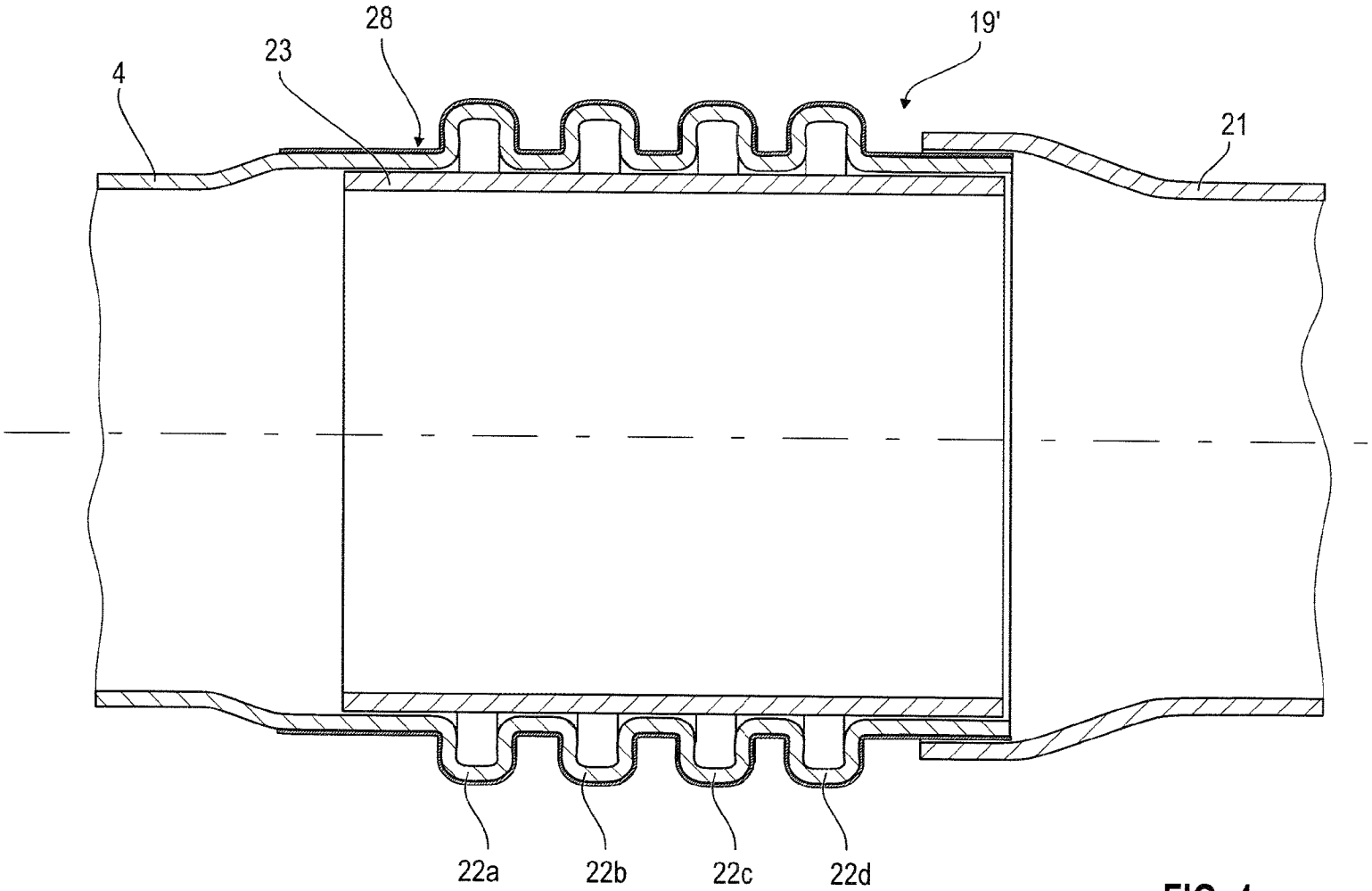
FIG. 4 shows a sectional illustration through a pipe connection between two exhaust pipe bends with the use of a second material layer.

FIG. 4 shows, in the form of a sectional image, the use of a plurality of material layers in the region of the compensator 19'. During the formation of the expansion bellows geometry in the high pressure forming operation, further material layers (such as, for example, a second material layer 28), which were placed loosely onto the inner pipe, are connected fixedly to one another by the forming operation and can therefore absorb increased forces.

In addition to the above written disclosure of the invention, reference is hereby explicitly made to the graphical illustration thereof in the figures.

LIST OF REFERENCE NUMBERS

1 Exhaust pipe bend
2 Input flange
3 T exhaust pipe
4 Collector component
4' Pipe portion
5 Bypass duct
6 Left spiral half
7 Right spiral half
8 Outlet duct
9 Outlet flange
10 Throttle plate
11 Throttle lever
12 Outlet sheet

13 Terminating sheet
14 Bearing housing flange
15 Rotor space
16 Lower cover
17 Turbine housing
18 Exhaust manifold
19 Welded seam between 6 and 7
19' Compensator
20 Internal combustion engine
21 Supply gas duct
22 Compensator bellows
**22*a*-22*d*** Expansion bellows portions
23 Supporting sleeve
24 Welding point
25 Pipe weld
26 Inner sliding fit
27 Connecting conduit
28 Second material layer

The invention claimed is:

1. An exhaust manifold (18) of an internal combustion engine (20) comprising:

at least one collector component (4), a number of exhaust pipe bends (1) corresponding to the number of cylinders of the internal combustion engine (20), each of said exhaust pipe bends having first and second ends and opening at their first end into an input flange (2) which can be fastened to the internal combustion engine (20), and having their second end in communication with one of said at least one collector component (4);

at least one supply gas duct (21) which is connected at one end to one of said at least one collector component (4) and at the other end to a rotor space (15) of a turbine housing (17) of a turbine of an exhaust-gas turbocharger;

at least one compensator (19') for compensating for thermal expansion in an axial direction between at least one exhaust pipe bend (1) and the at least one collector component (4) or between the at least one collector component (4) and the at least one supply gas duct (21), wherein the at least one exhaust pipe bend (1) or the collector component (4) is formed of sheet metal, and the at least one compensator (19') is formed in the sheet metal of the at least one exhaust pipe bend (1) or the collector component (4); and a supporting sleeve (23) extending in the axial direction of expansion, a majority of the supporting sleeve (23) being arranged within the compensator (19'), the supporting sleeve (23) supporting the at least one compensator (19') and preventing sagging transversely to the axial direction of compensation by absorbing bending forces.

2. The exhaust manifold as claimed in claim 1, wherein the compensator (19') is a compensator bellows (22).

3. The exhaust manifold as claimed in claim 1, wherein the supply gas duct (21) and the collector component (4) are welded to each other.

4. The exhaust manifold as claimed in claim 1, wherein at least the exhaust pipe bends (1) together with the compensator (19') are pipes formed by internal high pressure.

5. The exhaust manifold as claimed in claim 1, wherein the supporting sleeve (23) is placed loosely within the compensator (19'), and wherein the supporting sleeve (23) is not fixed to any structure.

6. The exhaust manifold as claimed in claim 1, wherein the supporting sleeve (23) is fixed at one of its ends to an exhaust pipe bend (1).

7. The exhaust manifold as claimed in claim 1, wherein the compensator (19') is provided with at least two sheet-metal layers.

8. The exhaust manifold as claimed in claim 1, wherein the supporting sleeve (23) is welded at one of its ends to the collector component (4).

9. The exhaust manifold as claimed in claim 1, wherein the turbine housing (17) is a twin scroll turbine housing.

10. The exhaust manifold as claimed in claim 1, wherein the turbine housing (17) is a single-flow turbine housing.

11. The exhaust manifold as claimed in claim 1, wherein the compensator (19') consists essentially of a compensator bellows.

12. The exhaust manifold as claimed in claim 1, wherein the supporting sleeve (23) has an associated length, and wherein the supporting sleeve (23) is cylindrical along the entire length.

13. A turbine housing (17) of an exhaust-gas turbocharger; which is provided with an exhaust manifold (18) as claimed in claim 1.

14. A turbine housing (17) of an exhaust-gas turbocharger comprising:

a supply gas duct (21) which is fluidly connected to a rotor space (15) of a turbine rotor, characterized by a compensator (19') as claimed in claim 1.

15. An exhaust manifold (18) of an internal combustion engine (20) comprising:

at least one collector component (4), a number of exhaust pipe bends (1) corresponding to the number of cylinders of the internal combustion engine (20), each of said exhaust pipe bends having first and second ends and opening at their first end into an input flange (2) which can be fastened to the internal combustion engine (20), and having their second end in communication with one of said at least one collector component (4);

at least one supply gas duct (21) which is connected at one end to one of said at least one collector component (4) and at the other end to a rotor space (15) of a turbine housing (17) of a turbine of an exhaust-gas turbocharger;

at least one compensator (19') for compensating for thermal expansion in an axial direction between at least one exhaust pipe bend (1) and the at least one collector component (4) or between the at least one collector component (4) and the at least one supply gas duct (21);

wherein the at least one exhaust pipe, bend (1) or the collector component (4) is formed of sheet metal, and the at least one compensator (19') is formed as a bellows in the sheet metal of the at least one exhaust pipe bend (1) or the collector component (4); and a supporting sleeve (23) extending in the axial direction of expansion, a majority of the supporting sleeve (23) being arranged within the compensator (19'), wherein the compensator (19') has an inner diameter and the supporting sleeve (23) has an outer diameter, and wherein the compensator (19') is supported at the inner diameter of the compensator by the supporting sleeve (23) at the outer diameter of the supporting sleeve, the supporting sleeve (23) preventing sagging transversely to the axial direction of compensation by absorbing the bending forces which occur.

* * * * *